US009466918B2

(12) United States Patent
Chen

(10) Patent No.: US 9,466,918 B2
(45) Date of Patent: Oct. 11, 2016

(54) SIGNAL CONNECTOR HAVING GROUNDING MEMBER FOR PRESSING AND PREVENTING FROM SHORT-CIRCUIT

(71) Applicant: SIMULA TECHNOLOGY INC., Taoyuan (TW)

(72) Inventor: Shih-Jui Chen, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 14/983,680

(22) Filed: Dec. 30, 2015

(65) Prior Publication Data

US 2016/0204540 A1 Jul. 14, 2016

(51) Int. Cl.
*H01R 13/648* (2006.01)
*H01R 13/56* (2006.01)
*H01R 24/70* (2011.01)

(52) U.S. Cl.
CPC ..... *H01R 13/56* (2013.01); *H01R 24/70* (2013.01)

(58) Field of Classification Search
CPC ..... H01R 13/65802; H01R 13/2442
USPC ..... 439/607.01, 701, 260, 626
See application file for complete search history.

(56) References Cited

U.S. PATENT DOCUMENTS 7,534,140 B2 * 5/2009 Zheng ..... H01R 23/6873 439/607.01
7,824,219 B2 * 11/2010 Wang ..... H01R 13/65802 439/607.27
7,914,299 B2 * 3/2011 Lee ..... G06K 19/07732 439/76.1
2014/0302709 A1 * 10/2014 Zhao ..... H01R 12/57 439/519

* cited by examiner

*Primary Examiner* — Phuongchi T Nguyen
(74) *Attorney, Agent, or Firm* — Bacon & Thomas, PLLC

(57) ABSTRACT

The present invention is to provide a signal connector which includes an insulating body having a plurality of through grooves cut through top and bottom surfaces thereof adjacent to a front end thereof; an insulating terminal seat mounted inside the insulating body and having a plurality of metal terminals fastened thereon and separated from each other; two metal grounding members having rear ends respectively assembled with the top and bottom surfaces of the insulating body, having pressing parts respectively formed adjacent to front ends thereof and corresponding in position to the through grooves and having insulating layers respectively covered on side surfaces thereof facing the through grooves; such that the pressing part is able to apply a restoring force on the metal terminal when the signal connector is plugged with other signal connector and the metal terminal is moved away from the insulating terminal seat through the corresponding through groove.

14 Claims, 5 Drawing Sheets

SIGNAL CONNECTOR HAVING GROUNDING MEMBER FOR PRESSING AND PREVENTING FROM SHORT-CIRCUIT

FIELD OF THE INVENTION

The present disclosure generally relates to a signal connector, more particularly to a signal connector having grounding member for pressing and preventing from short-circuit, which is able to effectively prevent a plurality of metal terminals installed therein from elastic fatigue and permanent deformation, so as to ensure the quality of electric connection provided by the signal connector, prevent the associated electronic device from being damaged because of electric short-circuit and then greatly improve the usage safety and extend the endurability of the signal connector.

BACKGROUND OF THE INVENTION

With the rapid development of information technology and of the electronic industry, various kinds of electronic devices (such as a tablet computer, smartphone, driving recorder, and so on) with excellent qualities, reasonable prices, compact sizes and light weights have become important and indispensable tools for most people in daily life and work. Most people get used to operate computers to process information in everyday life and work, and require more and more applications related to the computers. In order to facilitate people to transmit data (such as word files, multimedia files, figure file, and so on) between different electronic devices, manufacturers usually provide the electronic devices with various types of signal connectors to exchange data with other electronic device via the corresponding connection wires. Among transmission specifications of many connectors, Universal Serial Bus (hereafter refer to "USB") is the most popular specification because the connector compliant with USB specification can transmit data and actively provide 5V of voltage and 0.5 A of current to enable the electronic device connected thereto to operate by the power received from the connector compliant with USB specification without having to connect with an extra external power. Therefore, the USB connector has become one of primary specifications for connection between the electronic devices after the USB 1.0 was officially launched at 1996.

Currently, the USB specification will enter a new generation of USB 3.1 specification. In the USB 3.1 specification, maximal transmission voltage and current are increased and the coding loss is reduced, and the transmission rate is greatly improved to 10 GB per second. In addition, compared with the conventional USB 1.0 through USB 3.0 specifications, the USB 3.1 specification defines a novel USB Type-C connector which has a structure in up-down symmetry, so that user can arbitrarily insert the USB Type-C plug into a USB Type-C socket without recognizing front and back surfaces of the USB Type-C plug in advance, and operate the USB Type-C plug in a more intuitional way.

However, in order to achieve the both-side insertable function, the USB Type-C connector must be provided with two connection terminal sets identical to each other, it means that in the USB Type-C connector an extra connection terminal set must be tucked into a limited space which is equal to that of the conventional USB connector, and the separation spaces between the elements in the USB Type-C connector become smaller. Therefore, electric short-circuit certainly will be occurred easily because the conductors (such as connection terminals, grounding members, a metal housing, and so on) inside the USB Type-C connector are too close to each other, and may result in damage of the related electronic components and endanger safety of the user's life and property. It is a highly valued issue.

In addition, while using the USB Type-C connector, the user usually plug and pull the connector frequently and such actions are easy to cause elasticity loss of the connection terminals of the Type-C connector. If the inter-connected structures of the two Type-C connectors become loose, integrity of signals transmitted in high rate and stability of electric connection between the connection terminals are impacted. Therefore, the manufacturers have to redesign the hardware structure of the Type-C connector to fit with the small space, so as to improve the endurability and usage quality of the USB Type-C connector. In conclusion, what is need is to design a new connector structure to meet the specific structural requirement of the USB Type-C connector, and prevent the problems of permanent deformation of the connection terminal or other element due to elastic fatigue, and the electric short-circuit caused by too small distance between the conductors inside the USB Type-C connector, so as to enable the USB Type-C connector to be operated normally and stably for a long-term period.

SUMMARY OF THE INVENTION

In order to solve the problems that the conventional USB Type-C connector having many metal members (such as connection terminals, a metal housing and grounding members, and so on) is easy to cause electric short-circuit to damage the electronic device connected thereto, the inventor of the present invention put years of practical experience into research and design and finally succeeded in developing a signal connector using the grounding member for pressing and preventing from the short-circuit.

An objective of the present invention is to provide a signal connector compliant with USB Type-C specification and capable of preventing from short-circuit. The signal connector includes an insulating body, an insulating terminal seat, two metal grounding members and a metal housing. The insulating body has front and rear ends communicated with each to define an accommodating space inside, and has a plurality of through grooves cut through top and bottom surfaces thereof adjacent to a front end thereof and communicated with the accommodating space. The insulating terminal seat is mounted in the accommodating space, and has a plurality of first metal terminals and a plurality of second metal terminals fastened thereon and separated from each other. Each two of first metal terminals or the second metal terminals adjacent to each other are separated from each other. Each of the first metal terminals and the second metal terminals has an end exposed out of the front end of the insulating terminal seat and other end extended out of the rear end of the insulating terminal seat. Under a condition that the insulating terminal seat is mounted into the accommodating space through the rear end of the insulating body, parts of the plurality of first and second metal terminals adjacent to the front ends thereof correspond to the through grooves respectively, so that the parts of the plurality of first and second metal terminals can be moved away from the accommodating space through the through grooves under a condition that the signal connector is plugged with other signal connector. The metal grounding members have rear ends respectively assembled with the top and bottom surfaces of the insulating body adjacent to the rear end of the insulating body, and each has a pressing part formed adjacent to a front end thereof and corresponding in position to the plurality of through grooves, and has an insulating layer covered on a side surface thereof facing the plurality of through grooves. The pressing part is used to apply a restoring force on the plurality of first and second metal terminals under the condition that the signal connector is plugged with the other signal connector and the front ends of the plurality of first and second metal terminals are moved away from the accommodating space through the plurality of through grooves. The metal housing has a structure matching with the insulating body, and under a condition that the insulating body is assembled into the metal housing, the metal grounding members are clamped between the metal housing and the insulating body, and the insulating layers are respectively covered on the plurality of through grooves corresponding thereto, so that the plurality of metal terminals are effectively insulated from the metal housing under the condition that the signal connector is plugged with the other signal connector. Therefore, by means of the design of the pressing parts and the insulating layers, while the signal connector is plugged with the other signal connector and the front ends of the first and second metal terminals are moved away from the first accommodating space through the through grooves, the pressing parts can apply the restoring force on the first and second metal terminals to effectively prevent the elastic fatigue and permanent deformation of the first and second metal terminals, and the insulating layers can insulate the first and second metal terminals from the metal housing, to prevent the metal terminals from being contacted with the metal housing through the through grooves, so as to ensure the quality of electric connection and prevent the electronic device from being damaged because of electric short-circuit. Therefore, the signal connector can have greatly improved usage safety and extended endurability.

Other objective of the present invention is that each metal grounding member has at least one clamping part disposed at a front end thereof, and at least one protrusion protruded on a surface thereof opposite to the insulating body, and the metal grounding members and the protrusions are clamped between the metal housing and the insulating body under a condition that the insulating body is assembled into the second accommodating space, and intervals are formed between the metal grounding members and the metal housing because of existence of the protrusions, and the clamping parts are extended towards the front end of the insulating body in a suspending form, so that a part of each of the metal grounding members adjacent to the rear end thereof can generate a force of movement towards the insulating body while the protrusions are served as fulcrums for the metal grounding members respectively, to enable the parts of the first and second metal grounding members to be tightly abutted against the insulating body. In addition, the intervals can tolerate movements and deformations of the parts of the metal grounding members in a range, to effectively increase deformations and restorations of the clamping parts, so as to effectively prevent elastic fatigue of the clamping parts.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
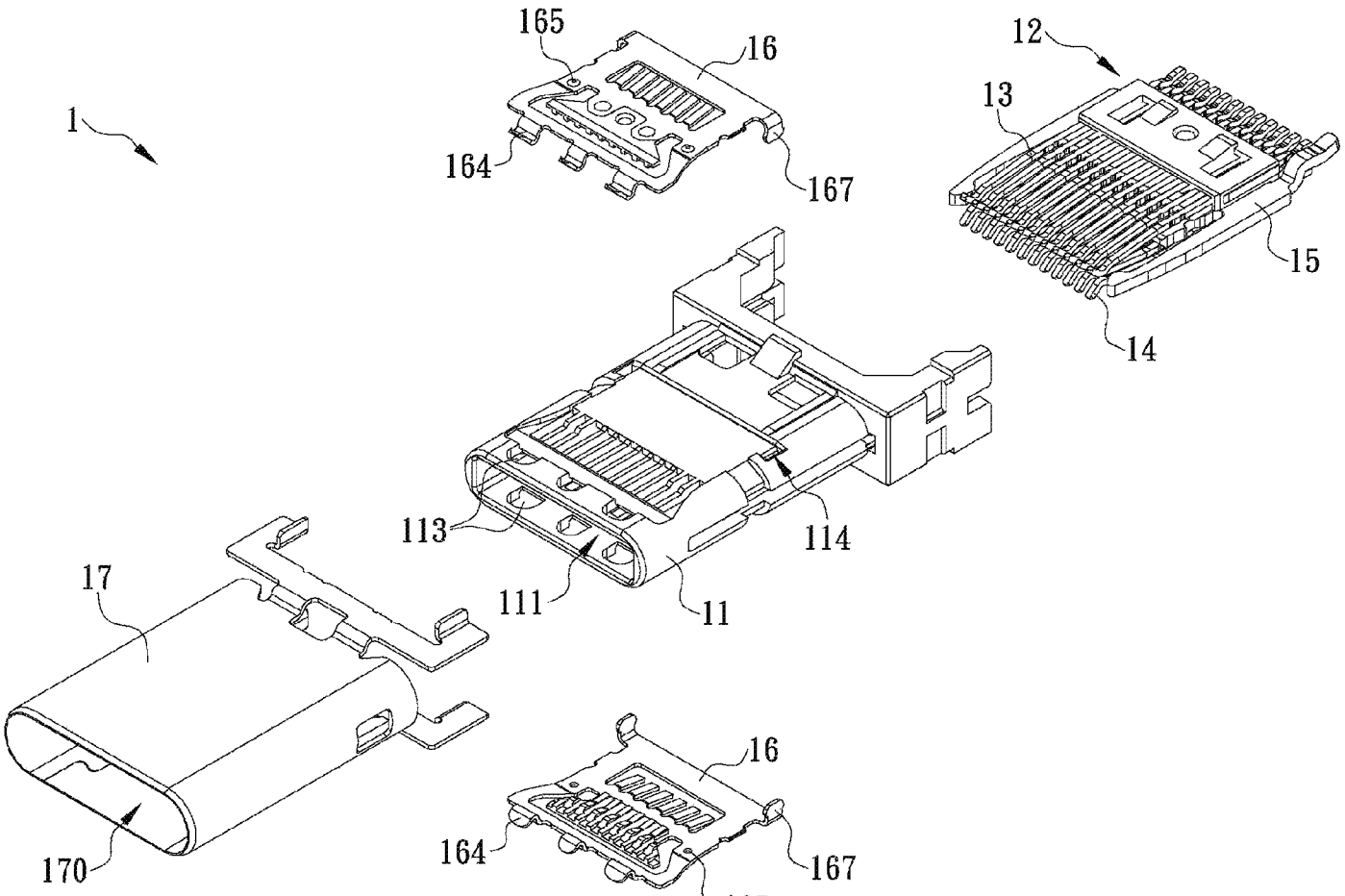
FIG. 1 is an perspective exploded diagram of a signal connector of the present invention.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present invention discloses a signal connector having a grounding member for pressing and preventing from short-circuit. Please refer to FIGS. 1 and 2. In a preferred embodiment of the present invention, the signal connector 1 is compliant with USB Type-C specification and includes an insulating body 11, an insulating terminal seat 12, two metal grounding members 16 and a metal housing 17. The bottom left of FIG. 1 is defined as the front of a device, the top right of FIG. 1 is defined as the back of the device, top left of FIG. 1 is defined as a left side of the device, and bottom right of FIG. 1 is defined as a right side of the device. The insulating body 11 is formed integrally by plastic material, and has two ends communicated with each other to define a first accommodating space 111 inside. The insulating body 11 further has a plurality of through grooves 112 cut through a top surface and a bottom surface thereof adjacent to a front end thereof and communicated with the first accommodating space 111.

Please refer back to FIGS. 1 and 2. The insulating terminal seat 12 is formed integrally by plastic material, and has a plurality of first metal terminals 13 and second metal terminals 14 fixed thereon. The first metal terminals 13 and the second metal terminals 14 are separated from each other, and each two of the first metal terminals 1 or the second metal terminals 14 adjacent to each other are also separated from each other. Each of the first and second metal terminals 13 and 14 has an end exposed out of a front end of the insulating terminal seat 12, and other end extended from a rear end of the insulating terminal seat 12. The insulating terminal seat 12 is mounted into the first accommodating space 111 through the rear end of the insulating body 11. Under a condition that the insulating terminal seat 12 is mounted in the first accommodating space 111, front ends of the first and second metal terminals 13 and 14 correspond in position to the through grooves 112 respectively. Therefore, when the signal connector 1 is plugged with other signal connector, the front ends of the first and second metal terminals 13 and 14 are deformed subjected to the pressing from metal terminals of the other signal connector, and moved away from the first accommodating space 111 through the through grooves 112 to be in electrical connection with the metal terminals of the other signal connector.

Figure 2:
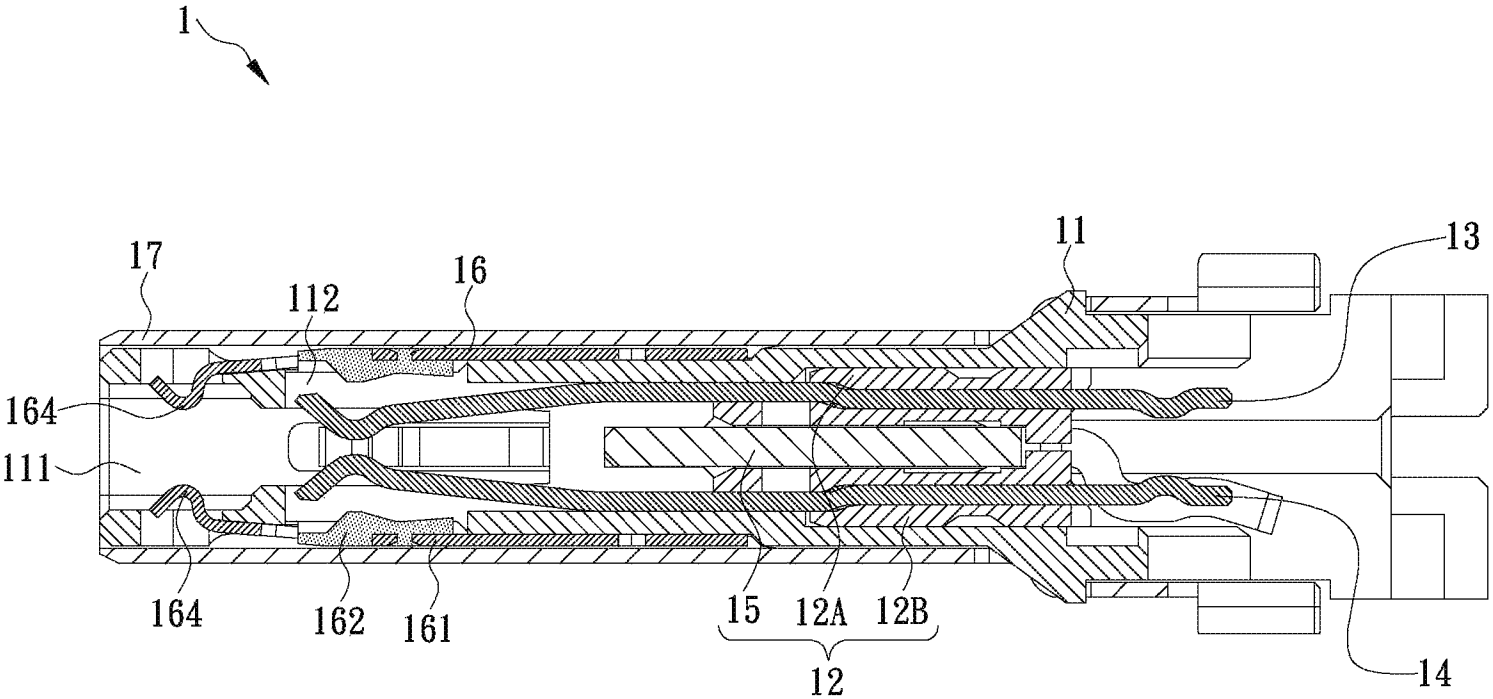
FIG. 2 is a cross-sectional schematic view of the signal connector of the present invention.
Figure 3:
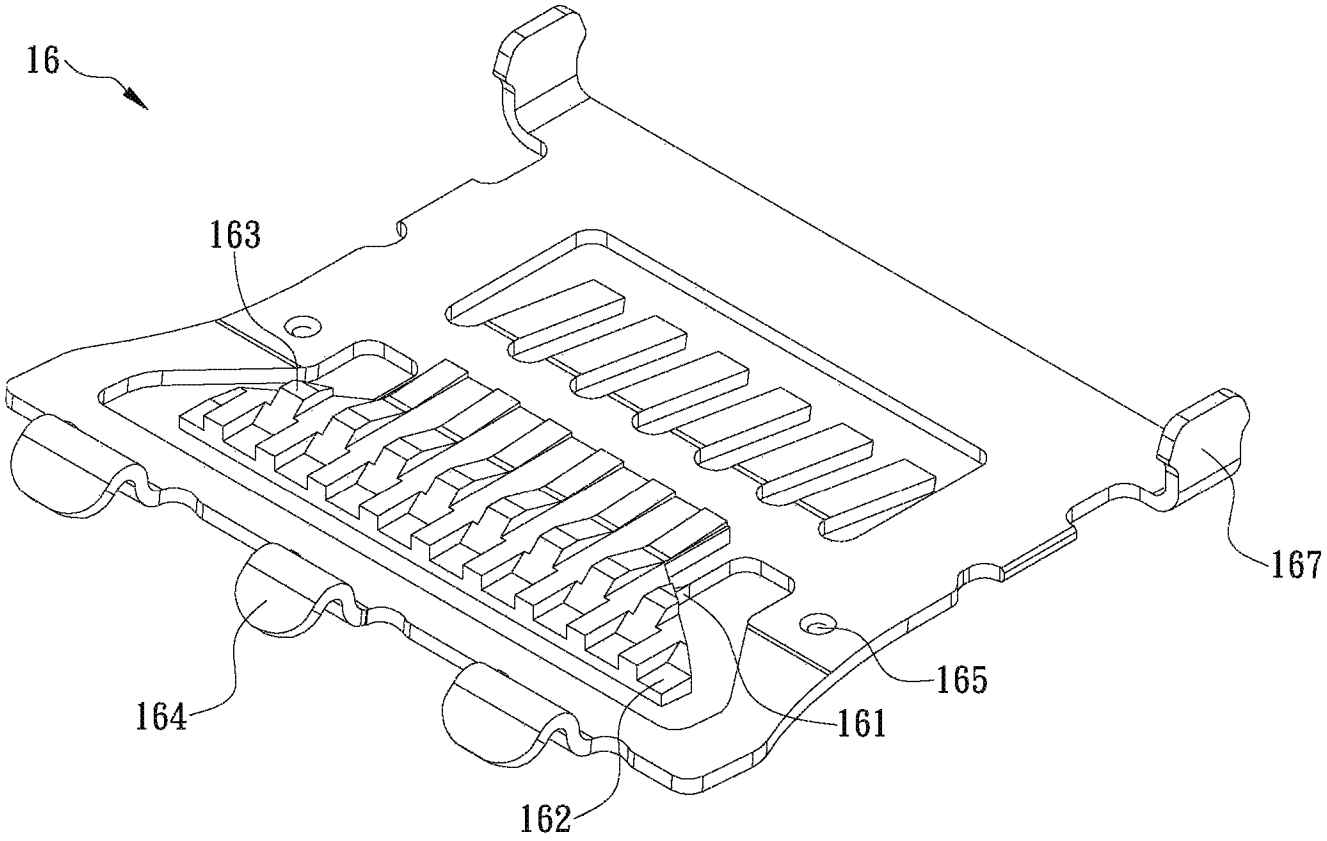
FIG. 3 is a perspective view of a metal grounding member of the present invention.

Please refer to FIGS. 1-3. Each of the metal grounding members 16 has a rear end assembled with the top or bottom surfaces of the insulating body 11 adjacent the rear end of the insulating body 11, and has a pressing part 161 located adjacent to the front end thereof. In the embodiment, the metal grounding member 16 is made from metal material by punching press, and during the punching press a hanging-arm is formed adjacent to a front end of the metal material to be the pressing part 161 of the metal grounding member 16, so that the pressing parts 161 have elasticity and correspond in position to the through grooves 112 respectively. An insulating layer 162 is covered on a side surface of the metal grounding member 16 facing the through grooves 112, so that under a condition that the signal connector 1 is plugged with the other signal connector and the front ends of the metal terminals 13 and 14 are moved away from the first accommodating space 111 through the through grooves 112, the pressing parts 161 can apply a restoring force on the first and second metal terminals 13 and 14 for returning them to their original positions. In the embodiment, the insulating layer 162 is formed integrally by covering insulation material on the pressing part 161, but the present invention is not limited thereto. Alternatively, in other embodiment of the present invention, the insulating layer 162 can be formed by attaching insulation material on the pressing part 161, or assembling the insulating layer 162 which has a structure matching with the pressing part 161 on the pressing part 161. In summary, it should be noted that the insulating layer 162 covered on the side surface of the insulating layer 162 facing the through grooves 112 by any formation is embraced by scope of the present invention.

Please refer back to FIGS. 1 and 2. The front and rear ends of the metal housing 17 are communicated with each other to define a second accommodating space 170 inside, and has a structure matching with the insulating body 11, so that the insulating body 11 can be assembled into the second accommodating space 170 through the rear end of the metal housing 17. While the insulating body 11 is assembled into the metal housing 17 (that is, in the second accommodating space 170), the metal grounding members 16 are clamped between the metal housing 17 and the insulating body 11, and the insulating layers 162 are respectively covered on the through grooves 112 corresponding thereto. Therefore, under the condition that the signal connector 1 is connected with the other signal connector, the first and second metal terminals 13 and 14 can be isolated from the metal housing 17 effectively, so as to prevent the front ends of the first and second metal terminals 13 and 14 from being contacted with the metal housing 17 to form abnormal loops while the front ends of the first and second metal terminals 13 and 14 are moved away from the first accommodating space 111 through the through grooves 112.

Please refer to FIGS. 1-3. In other preferred embodiment of the present invention, Each metal grounding member 16 has a plurality of rib structures 163 protruded on a side surface of the insulating layer 162 corresponding to the through grooves 112 and respectively positioned in the through grooves 112 corresponding thereto to shield the through grooves 112. Please refer to FIGS. 2-3. Each metal grounding member 16 has at least one clamping part 164 disposed on the front end thereof and curved toward the front end of the insulating body 11. The insulating body 11 has through hole 113 respectively cut through the top and bottom surfaces thereof and communicated with the first accommodating space 110. Each of the clamping parts 164 is inserted into the first accommodating space 110 through the corresponding through hole 113, to respectively extend towards the front end of the insulating body 11 in suspending form, as shown in FIG. 2. Therefore, under the condition that the signal connector 1 is plugged with the other signal connector, the clamping parts 164 can provide larger clamping strength to the other signal connector. However, in other embodiment of the present invention, the manufacturer can design the structure of the insulating body 11 not having the through hole 113, but the metal grounding member 16 can still be assembled on the insulating body 11 and the clamping parts 164 are in the suspending form, and it should be noted that such manner is also referred as the assembly way between the metal grounding member 16 and the insulating body 11 of the present invention.

Figure 4:
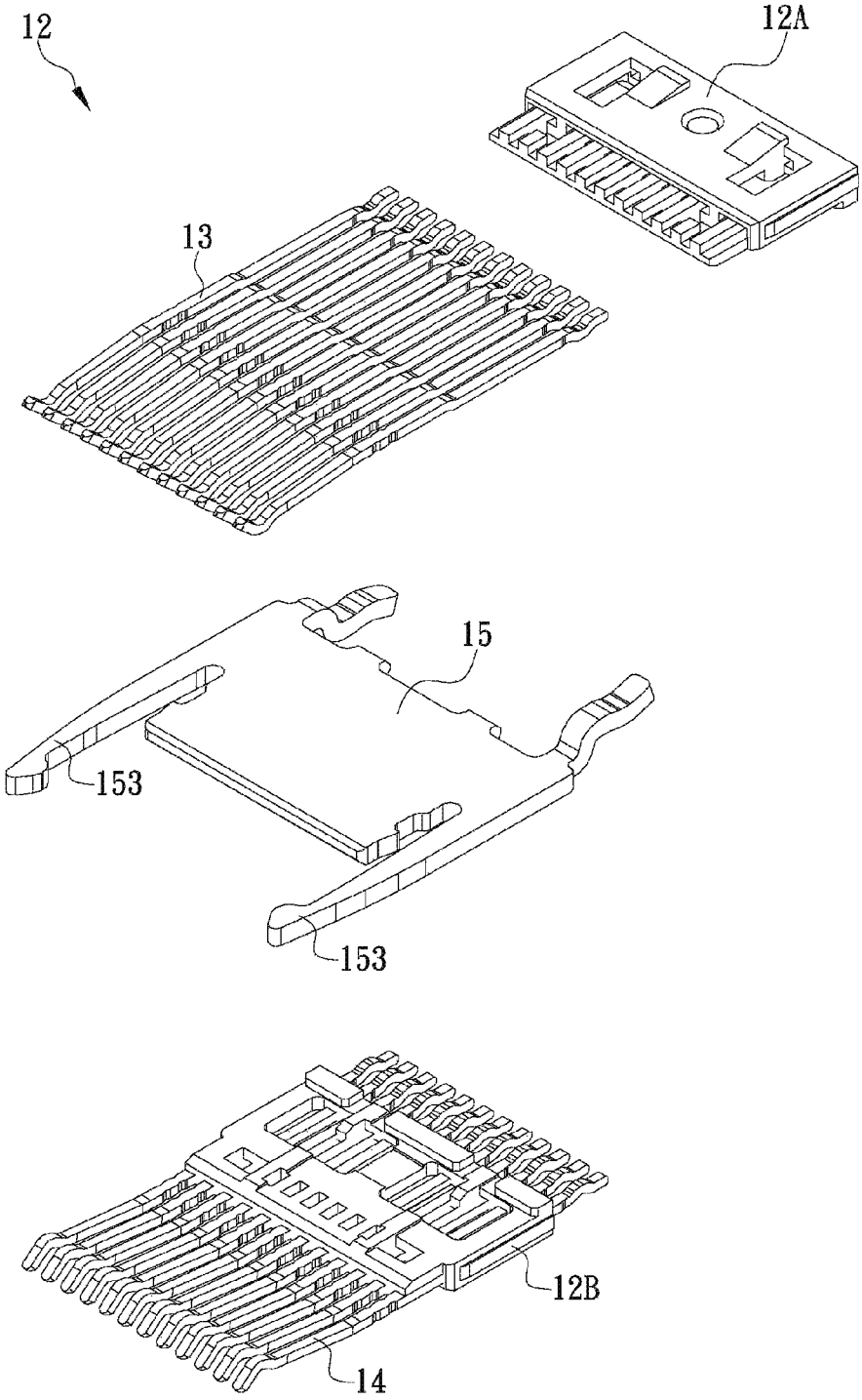
FIG. 4 is a perspective exploded view of an insulating terminal seat of the present invention.

Please refer to FIGS. 1, 3 and 4. In yet preferred embodiment of the present invention, the insulating terminal seat 12 includes a first base 12A, a second base 12B and a fastening device 15. The first base 12A and the second base 12B are made from insulating material, the first metal terminals 13 are assembled into the first base 12A, and the two ends of each of the first metal terminals 13 are respectively exposed out of the front and rear ends of the first base 12A, and the two first metal terminals 13 adjacent to each other are separated from each other. The second metal terminals 14 are assembled into the second base 12B, two ends of each of the second metal terminals 14 are respectively exposed out of the front and rear ends of the second base 12B, and the two second metal terminals 14 adjacent to each other are separated from each other. Moreover, the fastening device 15 has fastening arms 153 forwardly extended from left and right sides thereof respectively. When the first base 12A, the second base 12B and the fastening device 15 are assembled into the insulating terminal seat 12, the first base 12A and the second base 12B are respectively positioned on top and the bottom surfaces of the fastening device 15, to prevent the first metal terminals 13 and the second metal terminals 14 from being interfered by each other during signal transmission. The fastening arms 153 of the fastening device 15 are further exposed out of the left and right sides of the first base 12A and the second base 12B. Under the condition that the signal connector 1 is plugged with the other connector, the fastening arms 153 are fastened with the other signal connector to enable tight connection between the signal connector 1 and the other signal connector to prevent from coming loose from each other. However, in other embodiment of the present invention, the manufacturer can design the fastening device 15 not having the fastening arms 153, but the two signal connectors can be fastened with each other by other manner. Moreover, assembly of the first base 12A, the second base 12B and the fastening device 15 are not limited to aforesaid form, but can be changed upon the manufacturer's production and design demand. For example, the first base 12A and the second base 12B can be formed integrally, and the fastening device 15 is movably plugged between the first base 12A and the second base 12B; or, the first base 12A and the second base 12B can be formed on the fastening device 15 by injection molding. It should be noted that the present invention covers any insulating terminal seat 12 having whole structure above-mentioned after formation.

Figure 5:
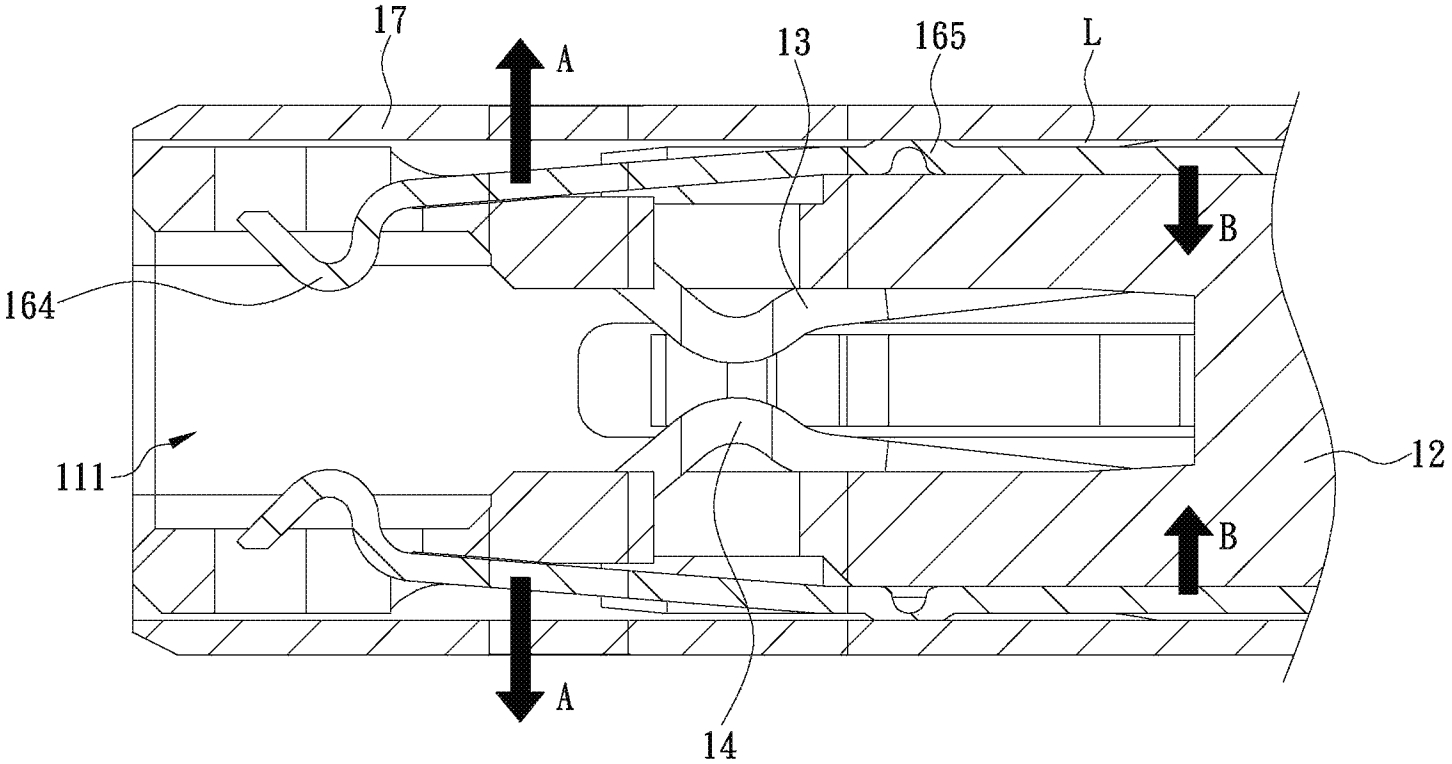
FIG. 5 is a cross-sectional schematic view of a part of the signal connector of the present invention.

Please refer to FIG. 1. In another preferred embodiment of the present invention, each metal grounding member 16 has at least one protrusion 165 protruded on a surface thereof opposite to the insulating body 11, and at least one engagement plate 167 disposed at a rear end thereof. The insulating body 11 has engagement holes 114 disposed on the top and bottom surfaces thereof respectively. Each engagement plate 167 can be engaged into the engagement hole 114 of the insulating body 11 corresponding thereto, so as to respectively assemble the rear ends of the metal grounding members 16 into the top and bottom surfaces of the insulating body 11 adjacent to the rear end of the insulating body 11. However, it should be note that, in other embodiment, the assembly of the metal grounding member 16 and the insulating body 11 can also be implemented by other way, and is not limited to aforesaid engagement plate 167 and engagement hole 114. Please refer to FIGS. 2 and 5. When the insulating body 11 is assembled into the second accommodating space 170, the metal grounding members 16 and the protrusions 165 are clamped between the metal housing 17 and the insulating body 11 and, in the meantime, intervals L are formed between the rear ends of the metal grounding members 16 and the inner sides of the metal housing 17 because of existence of the protrusions 165. Moreover, the protrusions 165 are respectively abutted against the inner sides of the metal housing 17, and each can be served as a fulcrum of the metal grounding member 16. While each metal grounding member 16 is being assembled into the metal housing 17, a part of the metal grounding member 16 adjacent to the rear end thereof is moved towards the inner side of the metal housing 17 and deformed to tightly abut against the insulating body 11 because of the elastic force of the metal grounding member 16, so that the clamping parts 164 located on the top and bottom surfaces of the insulating body 11 are naturally extended towards the front end of the insulating body 11 and inclined to each other. Therefore, under the condition that the connector 1 is plugged with the other connector, the clamping parts 164 can provide larger clamping strength to clamp the corresponding device of the other connector, so as to prevent the connector 1 and other the connector from coming loose from each other when the connector 1 or the electronic device connected thereto is collided.

Please refer back to FIGS. 1 and 5. While the metal grounding member 16 is provided with the protrusions 165 thereon, the clamping parts 164 can be inclined to each other, and moved and deformed to clamp the corresponding device of the other connector under the condition that the connector 1 is plugged with the other connector, as shown in an arrow A of FIG. 5. The protrusions 165 are served as fulcrums for the metal grounding member 16, so the part of each metal grounding member 16 adjacent to the rear end thereof is tightly pressed towards the insulating body 11 (as shown in an arrow B of FIG. 5), so that each metal grounding member 16 can be held more stably. In addition, in other embodiment, the interval L can tolerate movement and deformation of the part of the metal grounding member 16 adjacent to the rear end of the metal grounding member 16 in response to the different elasticity of metal grounding members 16 made from various materials, so that the movement of the clamping part 164 includes the deformation of the clamping part 164 and the movement of the part of the metal grounding member 16 adjacent to the rear end thereof. Therefore, the deformation and restoration of the clamping part 164 can be increased effectively to prevent the elastic fatigue of each clamping part 164 and extend endurability of the connector 1 efficiently.

Please refer back to FIGS. 1-3. In conclusion, by means of the design of the pressing parts 161 and the insulating layers 162, while the signal connector 1 is plugged with the other signal connector and the front ends of the first and second metal terminals 13 and 14 are moved away from the first accommodating space 111 through the through grooves 112, the pressing parts 161 can apply the restoring force on the metal terminals 13 and 14 to effectively prevent from the permanent deformation of the first and second metal terminals 13 and 14 caused by the elastic fatigue, and the insulating layer 162 can insulate the first and second metal terminals 13 and 14 from the metal housing 17, so as to prevent the metal terminals 13 and 14 from being contacted with the metal housing 17 through the through grooves 112, and further ensure the quality of electric connection and prevent the electronic device from being damaged because of electric short-circuit. Therefore, the signal connector 1 has greatly improved usage safety and extended endurability. In addition, by means of the structural feature of protrusions 165 disposed on the metal grounding member 16, the elastic fatigue of the clamping parts 164 can be prevented efficiently, so that other signal connector can be tightly clamped by the clamping parts 164 and the problem of loose connection is prevented.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A signal connector capable of preventing from short-circuit, comprising:

an insulating body having front and rear ends communicated with each other to define a first accommodating space inside, and having a plurality of through grooves cut through top and bottom surfaces thereof adjacent to a front end thereof and communicated with the first accommodating space;

an insulating terminal seat, mounted in the first accommodating space, having a plurality of first metal terminals and a plurality of second metal terminals fastened thereon and separated from each other, and each two of the first metal terminals or the second metal terminals adjacent to each other separated from each other, wherein each of the first metal terminals and the second metal terminals has an end exposed out of the front end of the insulating terminal seat and other end extended out of the rear end of the insulating terminal seat, and under a condition that the insulating terminal seat is mounted into the first accommodating space through the rear end of the insulating body, parts of the plurality of first and second metal terminals adjacent to the front ends thereof respectively correspond in position to the plurality of through grooves, so that the parts of the plurality of first and second metal terminals are movable away from the first accommodating space through the through grooves under a condition that the signal connector is plugged with other signal connector;

two metal grounding members having rear ends respectively assembled with the top and bottom surfaces of the insulating body adjacent to the rear end of the insulating body, and each of the two metal grounding members having a pressing part formed adjacent to a front end thereof and corresponding in position to the plurality of through grooves, and having an insulating layer covered on a side surface thereof facing the plurality of through grooves, and wherein the pressing part is configured to apply a restoring force on the plurality of first and second metal terminals under the condition that the signal connector is plugged with the other signal connector and the front ends of the plurality of first and second metal terminals are moved away from the first accommodating space through the plurality of through grooves; and a metal housing having front and rear ends communicated with each other to define a second accommodating space inside, and having a structure matching with the insulating body, and wherein the metal grounding members are clamped between the metal housing and the insulating body, and the insulating layers are respectively covered on the plurality of through grooves corresponding thereto under a condition that the insulating body is assembled into the second accommodating space, so that the plurality of metal terminals are insulated from the metal housing under the condition that the signal connector is plugged with the other signal connector.

2. The signal connector according to claim 1, wherein the pressing part is a hanging-arm formed at a part of the metal grounding member adjacent to the front end of the metal grounding member.

3. The signal connector according to claim 2, wherein the insulating layer has a plurality of rib structures protruded on a side surface thereof corresponding in position to the plurality of through grooves, the plurality of rib structures are respectively positioned in the plurality of through grooves corresponding thereto to completely shield the plurality of through grooves.

4. The signal connector according to claim 3, wherein the insulating layer is formed integrally by covering insulation material on the pressing part.

5. The signal connector according to claim 3, wherein the insulating layer is formed by attaching insulation material on the pressing part.

6. The signal connector according to claim 3, wherein the insulating layer has a structure matching with the pressing part and configured to be assembled on the pressing part.

7. The signal connector according to claim 3, wherein each of the first and second metal grounding members has at least one clamping part disposed at a front end thereof and curved towards the front end of the insulating body.

8. The signal connector according to claim 7, wherein each of the metal grounding members has at least one protrusion protruded on a surface thereof opposite to the insulating body, and the metal grounding members and the protrusions are clamped between the metal housing and the insulating body under the condition that the insulating body is assembled into the second accommodating space, intervals are formed between the metal grounding members and the metal housing because of existence of the protrusions, and the clamping parts are extended towards the front end of the insulating body in a suspending form, so that parts of the metal grounding members adjacent to the rear end thereof generate force of movement towards the insulating body while the protrusions are served as fulcrums for the metal grounding members respectively.

9. The signal connector according to claim 8, wherein the intervals are configured to tolerate movements and deformations of the parts of the metal grounding members adjacent to the rear ends of the metal grounding members in a range.

10. The signal connector according to claim 9, the insulating terminal seat further comprising:

a first base made from insulating material, and wherein the plurality of first metal terminals are assembled on the first base, each two of the plurality of first metal terminals adjacent to each other are separated from each other, and each of the plurality of first metal terminals has an end exposed out of a front end of the first base and other end extended out of a rear end of the first base;

a second base made from insulating material, wherein the plurality of second metal terminals are assembled on the second base, each two of the plurality of second metal terminals adjacent to each other are separated from each other, and each of the plurality of second metal terminals has an end exposed out of a front end of the second base and other end extend out of a rear end of the second base; and a fastening device assembled between the first base and the second base.

11. The signal connector according to claim 10, wherein the fastening device has fastening arms forwardly extended from left and right sides thereof respectively, and the fastening arms are exposed out of the left and right sides of the first base and the second base under a condition that the first base, the second base and the fastening device are assembled as the insulating terminal seat.

12. The signal connector according to claim 11, wherein the insulating body has through holes cut through top and bottom surfaces thereof respectively and communicated with the first accommodating space respectively, and each of the clamping parts is inserted into the first accommodating space through one of the through holes corresponding thereto, to extend towards the front end of the insulating body in a suspending form.

13. The signal connector according to claim 12, wherein the insulating body has engagement holes respectively disposed on top and bottom surfaces thereof, and each of the metal grounding members has at least one engagement plate disposed at a rear end thereof and configured to insert into one of the engagement holes corresponding thereto, to assemble the rear end of the metal grounding member on the insulating body.

14. The signal connector according to claim 13, wherein the insulating terminal seat is mounted into the first accommodating space through the rear end of the insulating body, the insulating body is assembled into the second accommodating space through the rear end of the metal housing.

* * * * *